US005555577A

United States Patent [19]

Volpe

[11] Patent Number: 5,555,577

[45] Date of Patent: Sep. 17, 1996

[54] CRIB ADAPTER

[76] Inventor: Rosemary Volpe, 34 Farmingdale Rd., Parsippany, N.J. 07054

[21] Appl. No.: 539,333

[22] Filed: Oct. 4, 1995

[51] Int. Cl.[6] ..... A47D 7/00; A47D 15/00

[52] U.S. Cl. ..... 5/93.1; 5/95

[58] Field of Search ..... 5/93.1, 95, 94, 5/98.3, 102, 655, 98.1, 120, 122; 4/572.1, 571.1

[56] References Cited

U.S. PATENT DOCUMENTS

| | | | |
|---|---|---|---|
| 1,454,112 | 5/1923 | Graves | 4/571.1 |
| 1,734,462 | 11/1929 | Gottlieb | 4/572.1 |
| 2,916,744 | 12/1959 | May et al. | 5/102 |
| 3,610,716 | 10/1971 | Weinberg et al. | 5/93.1 |
| 3,735,430 | 5/1973 | Platz | 5/94 |
| 3,848,277 | 4/1974 | Reguitti | 5/11 |
| 4,146,885 | 3/1979 | Lawson, Jr. | 5/93.1 |
| 5,153,954 | 10/1992 | Ohman | 5/93.1 |
| 5,349,709 | 9/1994 | Cheng | 5/93.1 |

FOREIGN PATENT DOCUMENTS

| | | | |
|---|---|---|---|
| 24709 | 11/1911 | United Kingdom | 5/95 |

*Primary Examiner*—Alexander Grosz
*Attorney, Agent, or Firm*—Terrance L. Siemens

[57] ABSTRACT

An adapter for suspending an air permeable sleeping surface from the top rails of a baby crib. The adapter has hooks engaging the rails, which hooks support a rectangular, permimetric frame. A flexible mesh fabric sleeping surface is removably attached to the frame. The hooks hold the sleeping surface well above and out of contact with the mattress of the crib, so that a child lying on his or her abdomen will not suffocate due to contact with the mattress, its cover, or a pillow. This situation could arise given the less yielding and more obstructing nature of a mattress and associated blankets and the like. In a preferred embodiment, the sleeping surface has reinforcing straps for opposing excessive deformation due to weight of the child.

3 Claims, 2 Drawing Sheets

CRIB ADAPTER

BACKGROUND OF THE INVENTION

1. Field of the Invention

The present invention relates to a suspended net for supporting a sleeping infant above the mattress of a crib. The net is suspended from the railings of the crib. The child is far less apt to be smothered when facing downwardly than would be the case when resting directly upon the mattress.

2. Description of the Prior Art

Cribs are beds specifically adapted for accommodating young infants. An infant placed in a crib to sleep will invariably move about, and there exists the hazard that in so doing, the infant will suffocate. This is because the infant may come to rest upon his or her abdomen, the head pressed against the mattress. Blankets, pillow, and the like are highly flexible, and may come to be pressed closely against the face of the infant. In this condition, it is possible that the blanket or other object will obstruct breathing with potentially fatal results. Infants are so undeveloped physiologically that they are frequently unable to move on their own to relieve this condition. Indeed, it is possible that the child will not even notice the condition, and will drift into unconsciousness.

This is but one of the hazards present in a crib. prior art has recognized some of these hazards and undesirable conditions present in a crib, but has not proposed a solution for the particular hazard described above.

The problem addressed in U.S. Pat. No. 5,153,954, issued to Ross L. Ohman on Oct. 13, 1992, is to maintain a sleeping infant covered by a blanket while not enabling the child to become entangled within the blanket. This goal is achieved by suspending the blanket above the child so that it cannot come to wrap around the child's body. The child remains in close contact with the mattress and its attendant mattress cover or sheet, and with the pillow. It would be possible for the child to suffocate on the latter items even if the blanket is suspended safely above. The present invention addresses the hazard from below by suspending the child on a net or other highly air permeable web. Also, the suspension system of Ohman differs from that of the present invention.

In U.S. Pat. No. 2,916,744, issued to David E. May et al. on Dec. 15, 1959, there is described a folding baby cradle which employs netting in the fabric panels which support and surround the child. Unlike the present invention, this is a self-contained unit which does not cooperate with a crib.

An infant carrier shown in U.S. Pat. No. 3,735,430, issued to Charles W. Platz on May 29, 1973, features hangers for suspending the carrier from environmental surfaces. Unlike the present invention, the floor of this carrier comprises padding laid over a rigid, solid planar material. Also in contradistinction to the present invention, the lateral walls of the cover of Platz's carrier are constructed with cushioning and rigidity in mind. Platz proposes constructions, such as quilting, which would operate contrary to the purposes of the present invention.

U.S. Pat. No. 4,146,885, issued to William H. Lawson, Jr. on Mar. 27, 1979, describes an infant's bed for detecting apnea. The invention operates by monitoring pressure maintained in a chamber sealed by an air impermeable sheet on which the child rests. This feature is directly contrary to the construction and purposes of the present invention. Also, suspension of the sheet is achieved differently from suspension of a corresponding sheet in the present invention.

U.S. Pat. No. 3,610,716, issued to Steven H. Weinberg et al. on Oct. 5, 1971, describes an air filtration system for filtering air delivered to ganged cribs for neonates. The air is delivered from a lateral side. Therefore, unlike the present invention, the surface on which the child sleeps is of relatively solid, air impermeable construction. Unlike the present invention, there is no provision for suspending a sleeping surface within a crib.

None of the above inventions and patents, taken either singly or in combination, is seen to describe the instant invention as claimed.

SUMMARY OF THE INVENTION

The present invention provides a sleeping surface attachable to a conventional crib, the sleeping surface allowing a sleeping child to breathe when facing downwardly. This is accomplished by providing a material which is permeable to air currents to be suspended from the crib so as to remain well above and out of contact with the mattress and associated bedclothes, pillows, and the like.

The apparatus includes a perimetric frame generally conforming to the mattress area of the crib, so that the surface area available to the infant remains substantially similar to that provided by the mattress. An open mesh flexible fabric is removably attached to the frame, by snaps, zipper, hook and loop material, or in any other suitable way. Apart from facilitating assembly, this arrangement enables the fabric to be washed.

The frame assures that the sleeping surface provide an effective area generally equivalent to that afforded by the mattress, so that a child has sufficient space to change position and reorient himself or herself as desired.

The novel device engages the crib by downwardly open hooks attached to the frame. The device is therefore installed quite securely merely by lowering it into position onto the crib. The hooks are dimensioned and configured to assure that the sleeping surface remain sufficiently above and out of contact with potentially hazardous bedclothes.

The sleeping surface preferably comprises an open mesh fabric. It will be appreciated that while bedclothes, blankets, mattress, and similar objects are air permeable, they obstruct air flow to a certain extent. It is possible for an infant to become asphyxiated despite mere air permeability. A critical property of the fabric providing the sleeping surface is that it is permeable to air currents arising from an infant's natural breathing. This is normally achieved by a relatively open mesh, i.e., one in which open space exceeds area devoted to fibers.

This property need not result in the flat, perforated appearance and construction typical of netting. It would be possible to provide a web of material of substantial thickness, provided there is a substantially open labyrinth existing among the fibers, coils of solid material, or other porous solid forming the web.

The frame also assists in preventing the sleeping surface from collapsing in the manner of a net surrounding an object. The net, when raised, will reduce in diameter as the weight of the enclosed object draws the center of the net downwardly. In a further step to prevent excessive collapse or deformation, reinforcing straps are sewn onto or otherwise attached to the fabric.

Accordingly, it is a principal object of the invention to provide an air current permeable sleeping surface for an infant.

It is another object of the invention to suspend the sleeping surface from a conventional crib, above and out of contact with the mattress and bed clothes of the crib.

It is a further object of the invention that the sleeping surface securely rest upon the top rails of the lateral walls of the crib.

Still another object of the invention is to assure that the sleeping surface span the mattress area of the crib.

An additional object of the invention is to assure that the sleeping surface not sag and deform excessively due to the weight of the sleeping child.

It is again an object of the invention that the fabric of the sleeping surface be removable from the novel device.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
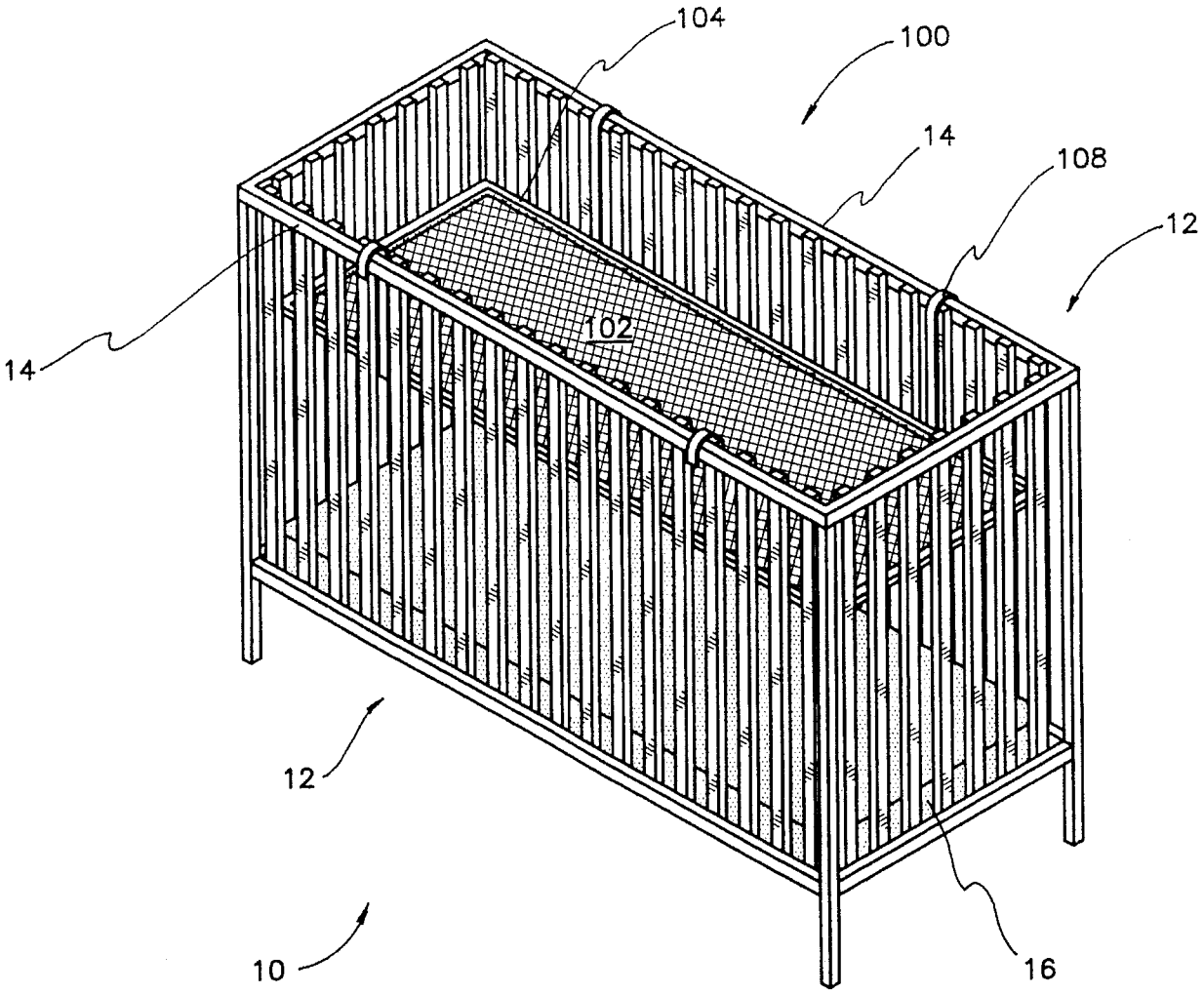
FIG. 1 is an environmental, perspective view of the invention.
Figure 3:
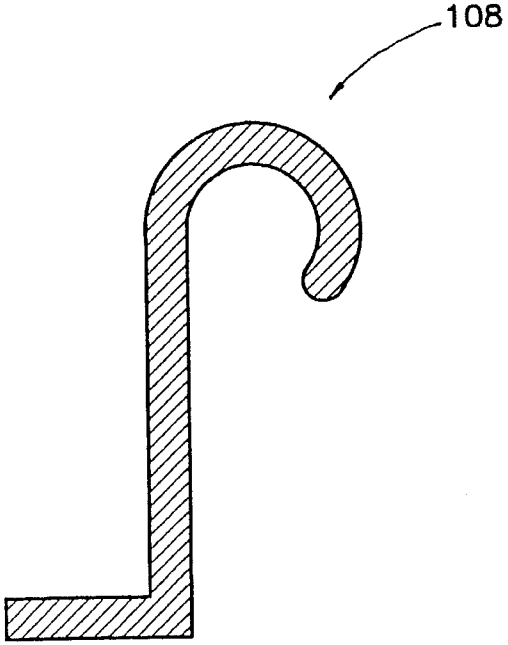
FIG. 3 is a side cross sectional view of a hook supporting the novel device from the railings of the crib.

Turning now to FIG. 1 of the drawings, the novel crib adapter 100 is shown installed in a crib 10. Crib 10 is of conventional construction, having right and left lateral walls 12 each having a railing 14. A mattress 16 is disposed in conventional fashion, supported by the frame of crib 10.

A fabric sleeping surface member 102 is attached to a perimetric frame member 104. Frame member 104 is preferably rectangular, conforming to the area above mattress 16. Frame member 104 is preferably tubular, so that sleeping surface member 102 can be readily slipped over frame member 104. Sleeping surface member 102 is fastened in place by suitable fasteners 106, such as snaps, a zipper, hook and loop material, or the like.

Frame member 104, and therefore also sleeping surface member, is suspended in place by suitable hooks 108, which slip over the railings 14. Hooks 108 are open downwardly, so that crib adapter 100 is easily lowered into place within crib 10 and removed therefrom.

Figure 2:
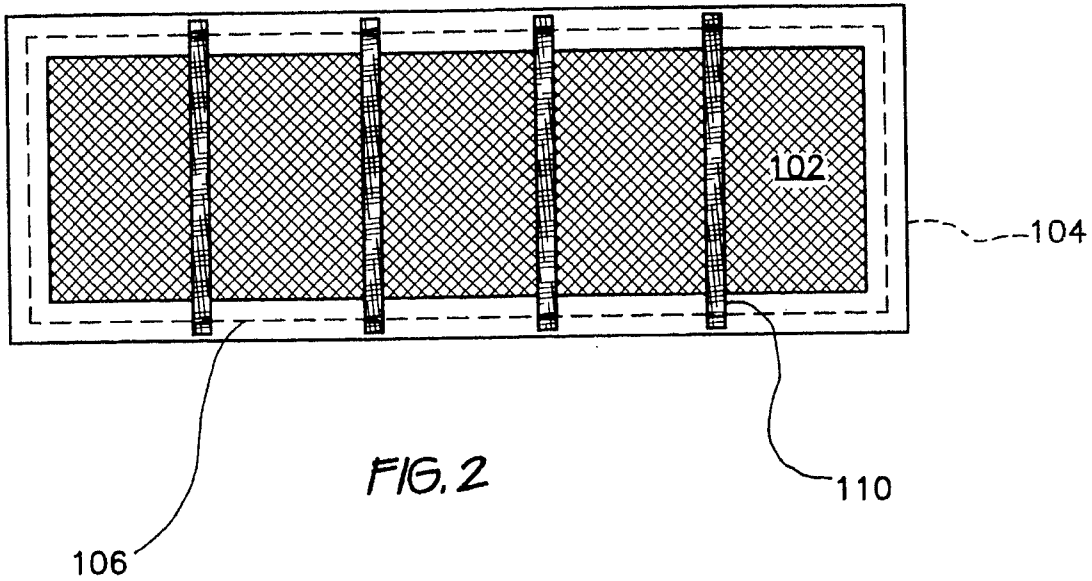
FIG. 2 is a bottom plan view of the invention.

Turning to FIG. 2, sleeping surface member 102 is shown attached to frame member 104. In a preferred embodiment, a plurality of reinforcing straps 110 are sewn or otherwise attached to sleeping surface member 102. If parallel and spaced apart from one another, relatively few reinforcing straps 110 will successfully oppose objectionable collapse and deformation of sleeping surface member 102 due to concentration of the weight of the infant over a limited area.

Sleeping surface member 102 is flexible, in order to yieldingly accommodate the child's body. Attachment of member 102 to frame member 104, coupled with the restraining influence of reinforcement straps 110, restrain excessive play and deformation of the sleeping surface.

It is to be understood that the present invention is not limited to the embodiments described above, but encompasses any and all embodiments within the scope of the following claims.

I claim:

1. A crib adapter for supporting an infant safely above the mattress of a crib having a mattress and lateral walls including top rails, said crib adapter comprising:

a sleeping surface panel providing a sleeping surface for the infant, said sleeping surface panel fabricated from a flexible fabric permeable to air currents; and suspension means for suspending said sleeping surface panel from the lateral walls of the crib, said suspension means maintaining said sleeping surface panel above and out of contact with the mattress and comprising a plurality of downwardly open hooks for engaging the top rails of the crib, each one of said open hooks attached to said sleeping surgace panel, said sleeping surface panel further comprising a perimetric frame, said flexible fabric removeably attached to said perimetric frame, and said sleeping surface panel having fastening means enabling manual removal of said flexible fabric from said perimetric frame.

2. The crib adapter according to claim 1, said sleeping surface panel comprising a plurality of reinforcing straps attached to said flexible fabric, for opposing excessive deformation of said sleeping surface panel due to weight of a child.

3. A crib adapter for supporting an infant safely above the mattress of a crib having a mattress and lateral walls including top rails, said crib adapter comprising:

a sleeping surface panel providing a sleeping surface for the infant, said sleeping surface panel comprising a perimetric frame, and a flexible fabric permeable to air currents, said flexible fabric removably attached to said perimetric frame, said sleeping surface panel having fastening means enabling manual removal of said flexible fabric from said perimetric frame, and a plurality of reinforcing straps for opposing excessive deformation of said sleeping surface panel due to weight of a child, said reinforcing straps attached to said flexible fabric; and a plurality of downwardly open hooks for engaging the top rails of the crib, each one of said open hooks attached to said perimetric frame, for suspending said sleeping surface panel from the lateral walls of the crib, said hooks dimensioned and configured to maintain said sleeping surface panel above and out of contact with the mattress.

* * * * *